US007044213B2

(12) United States Patent
Chang et al.

(10) Patent No.: US 7,044,213 B2
(45) Date of Patent: May 16, 2006

(54) CONSTANT TEMPERATURE REFRIGERATION SYSTEM FOR EXTENSIVE TEMPERATURE RANGE APPLICATION AND CONTROL METHOD THEREOF

(75) Inventors: Wen-Ruey Chang, Judung Hsinchu (TW); Der-Yung Liu, Judung Hsinchu (TW); Chan-Hsiang Chang, Judung Hsinchu (TW)

(73) Assignee: Industrial Technology Research Institute, Hsin Chu (TW)

( * ) Notice: Subject to any disclaimer, the term of this patent is extended or adjusted under 35 U.S.C. 154(b) by 204 days.

(21) Appl. No.: 10/331,991

(22) Filed: Dec. 31, 2002

(65) Prior Publication Data

US 2004/0123982 A1 Jul. 1, 2004

(51) Int. Cl.
*F25B 29/00* (2006.01)
*F28F 27/00* (2006.01)
*F28F 27/02* (2006.01)

(52) U.S. Cl. ..... 165/263; 165/264; 165/63; 165/64; 165/61; 165/293; 165/288; 165/294; 165/298; 165/299

(58) Field of Classification Search ..... 165/263, 165/264, 63, 64, 61, 247, 293, 294, 288, 165/298, 299
See application file for complete search history.

(56) References Cited

U.S. PATENT DOCUMENTS 3,550,677 A * 12/1970 Knowles ..... 165/299
5,970,729 A * 10/1999 Yamamoto et al. ..... 62/178
6,415,858 B1 * 7/2002 Getchel et al. ..... 165/206
6,749,016 B1 * 6/2004 Ozawa ..... 165/264
6,783,080 B1 * 8/2004 Antoniou et al. ..... 236/78 D
6,827,142 B1 * 12/2004 Winkler et al. ..... 165/298
2003/0209609 A1 * 11/2003 Takamura et al. ..... 236/12.11

* cited by examiner

*Primary Examiner*—John K. Ford
(74) *Attorney, Agent, or Firm*—Arent Fox PLLC

(57) ABSTRACT

A constant temperature refrigeration system for extensive temperature range application comprising a refrigerator, a low-temperature heat exchanger, a medium-temperature heat exchanger, a high-temperature heat exchanger, a pump, a first solenoid valve, a second solenoid valve, a third solenoid valve, a temperature sensor, a power regulator and a controller, the temperature sensor is utilized for determining the working fluid temperature and compare the actual input temperature, the actual output temperature and the predetermined temperature, and the controller is utilized for controlling the first solenoid valve, the second solenoid valve and the third solenoid valve for conveying the fluid to flow through various heat exchangers so that the working fluid is heated or cooled, with the result being that the working fluid temperature outputted is to reach the predetermined temperature, so as to acquire the working fluid having the exactly and precisely predetermined low temperature (−40° C. to 25° C.), medium temperature (25° C. to 50° C.) or high temperature (50° C. to 100° C.) required during various industrial manufacturing processes, a design that provides users with the energy-saving function and system maintenance for normal operations.

4 Claims, 7 Drawing Sheets

CONSTANT TEMPERATURE REFRIGERATION SYSTEM FOR EXTENSIVE TEMPERATURE RANGE APPLICATION AND CONTROL METHOD THEREOF

BACKGROUND OF THE INVENTION

1. Field of the Invention

The present invention relates to a constant temperature refrigeration system for extensive temperature range application and control method thereof, more particularly, a refrigeration system and a method for controlling such refrigeration system; such refrigeration system is for keeping working fluids under constant temperature, and such working fluids are utilized for manufacturing processes in semiconductor, biochemical material, food-processing and original material industries.

2. Description of Related Arts

Refrigeration equipment required by general manufacturing processes usually adopts coolant compression refrigerators in accordance with electrical heating device for automatic compensation, thus achieving the dual functions of heating and cooling, and accurately maintaining the predetermined temperature of working fluids such as coolants, non-freezing liquids, brine or liquid mixtures for manufacturing processes.

The conventional constant temperature refrigeration system 2 is shown in FIG. 8, comprising a tank 20 having an input conduit 27 and an output conduit 28, a pump 26 connected in tandem with the output conduit 28, an evaporator 21 mounted in the tank 20 for providing with cooling source, a heater 22 mounted in the tank 20 for providing heat source, a refrigerator connected in tandem with the evaporator 21, including a condenser 23, an inflation valve 24 and a compressor 25 for providing with the coolant loop. The output conduit 27 is for introducing the working fluid into the tank 20, whereas the output conduit 28 is then for outputting the working fluid having exactly the predetermined temperature required by manufacturing processes.

Since the conventional constant temperature refrigeration system 2 utilizes one set of cooling source to proceed to cooling and a set of heat source to proceed to heating compensation, for the evaporator 21 providing with the cooling source and the heater 22 providing with the heating source are both placed in the identical tank 20, no abnormal operation shall occur for the compressor 25 if applied in manufacturing processes or constant temperature control under smaller heat load. However, for applications under larger heat load for longer periods of time, the design of placing the cooling source and the heating source in the identical tank may easily cause abnormal actuation for high-temperature model compressors.

In addition, general refrigeration systems are usually designed for providing the environmental temperatures under certain low temperature ranges (such as −40° C. to 0° C.), as for applications requiring temperatures high than room temperatures (such as 60° C. to 100° C.), were low-temperature refrigeration systems utilized for maintaining the high-temperature cooling function, electricity shall be wasted, along with tremendous strain on the length of life for compressors because of the huge temperature differences; especially for apparatus in manufacturing processes required to run non-stop 24-hours per day for long periods of time, the energy put into such manufacturing processes shall surely be excessively wasted. For example, the vaporization temperature of the coolant in the conventional refrigeration system 2 shown in FIG. 8 is about −40° C. to 0° C., but if under high-temperature operation, the coolant drawn back to the compressor 25 shall be overheated to even reach 70° C. to 100° C., thus causing the conduit to be under high-pressure state for such overheated coolant is drawn therein, and then the efficiency for the compressor 25 to draw in the coolant is reduced to the extent that the coolant might not even be drawn smoothly back into the compressor 25, thus causing the refrigeration system 2 to lose the equilibrium and therefore the normal operation of the overall refrigeration system is endangered, a result that shall cause serious delay of production.

SUMMARY OF THE INVENTION

The primary object of the present invention is to provide a constant temperature refrigeration system for extensive temperature range application, which applies the facility water usually prepared by general semiconductor, biochemical material, food-processing and original material industries, and the refrigeration system thereof such as liquid chillers and cooling towers, in accordance with conduits and certain solenoid valves, so that as different solenoid valves are switched ON or OFF according to different temperature requirement, so as to acquire the working fluid having the exactly and precisely predetermined low temperature (−40° C. to 25° C.), medium temperature (25° C. to 50° C.) or high temperature (50° C. to 100° C.) required during various industrial manufacturing processes, a design that provides users with the energy-saving function and system maintenance for normal operations.

The constant temperature refrigeration system for extensive temperature range application capable of providing the foregoing functions comprises a refrigerator, a low-temperature heat exchanger, a medium-temperature heat exchanger, a high-temperature heat exchanger, a pump, a first solenoid valve, a second solenoid valve, a third solenoid valve, a temperature sensor, a power regulator and a controller, the refrigerator, the low-temperature heat exchanger, the medium-temperature heat exchanger, the high-temperature heat exchanger, the pump, the first solenoid valve, the second solenoid valve and the third solenoid valve being connected via conduits and being mounted with an input end and an output end, a working fluid being introduced therein via the input end and driven thereout via the output end by the pump, the power regulator being utilized for regulating the load carried by the high-temperature heat exchanger, the temperature sensor being utilized for predetermining the output temperature of the working fluid, the controller being utilized for controlling the first solenoid valve, the second solenoid valve and the third solenoid valve for conveying the fluid to various the heat exchangers to heat or cool the working fluid, with the result being that the temperature of the working fluid outputted being caused to reach the predetermined temperature, thus achieving the constant temperature control.

Preferably, the medium-temperature heat exchanger and the high-temperature heat exchanger are both placed in a tank mounted at the input end, and the tank, the pump and the conduit of the output end are connected in tandem with the first solenoid valve, whereas the second solenoid valve is connected in tandem on the conduit of the medium-temperature heat exchanger, and whereas the third solenoid valve is connected in tandem on the conduit of the low-temperature heat exchanger while connecting in parallel with the first solenoid valve.

Preferably, the high-temperature heat exchanger and the pump are both mounted at the output end, with the conduit thereof being connected in tandem with the first solenoid valve thereon, the second solenoid valve is connected in tandem on the conduit of the medium-temperature heat exchanger while connecting in parallel with the first solenoid valve, whereas the third solenoid valve is connected in tandem on the conduit of the low-temperature heat exchanger while connecting in parallel with the first solenoid valve.

Preferably, the high-temperature heat exchanger and the pump are both mounted at the input end, with the conduit thereof being connected in tandem with the first solenoid valve thereon, whereas the second solenoid valve is connected in tandem on the conduit of the medium-temperature heat exchanger while connecting in parallel with the first solenoid valve, and whereas the third solenoid valve is connected in tandem on the conduit of the low-temperature heat exchanger while connecting in parallel with the first solenoid valve.

Preferably, the working fluid is coolant, non-freezing solution, brine or liquid mixture for the manufacturing process.

The another object of the present invention is to provide a method for controlling the constant temperature refrigeration system for extensive temperature range application, whereby the working fluid temperature is predetermined and the actual input temperature, the actual output temperature and the predetermined temperature are compared, subsequently the first solenoid valve, the second solenoid valve and the third solenoid valve are switched ON or OFF according to the foregoing comparison for conveying the fluid to various heat exchangers, so that the working fluid is heated or cooled, with the result being that the working fluid temperature outputted is to reach the predetermined temperature, so as to acquire the working fluid having the exactly and precisely predetermined low temperature (−40° C. to 25° C.), medium temperature (25° C. to 50° C.) or high temperature (50° C. to 100° C.) required during various industrial manufacturing processes.

The method for controlling a constant temperature refrigeration system for extensive temperature range application capable of achieving the foregoing function comprises steps as follows:

a. Predetermine the temperature of the working fluid needed for the refrigeration system;
b. Actuate the pump whereby the working fluid and the facility water are respectively introduced into the refrigeration system;
c. Compare the temperature differences between the inputting temperature, the outputting temperature and the predetermined temperature by the temperature sensor;
d. Transmit signals of the temperature differences to the controller for controlling the first, second and third solenoid valves such that the working fluid is to flow through the low, medium and high temperature heat exchangers; and
e. Heat or cool the working fluid through controlling the first, second and third solenoid valves, such that the temperature of the working fluid outputted is to reach the predetermined temperature required by manufacturing processes.

Preferably, a refrigerator is utilized for providing with temperature lower than 25° C. during low-temperature application, such that heat energy generated during the manufacturing process may be brought away under the low-temperature environment for the energy-saving purpose.

Preferably, the facility water having the temperature higher than 25° C. is utilized during medium-temperature application, such that power utilized during temperature control over 25° C. may be reduced for the energy-saving purpose.

Preferably, a high-temperature heat exchanger is utilized during high-temperature application, the high-temperature heat exchanger being constantly under the "ON" state after the refrigeration system is actuated, and the power regulator is utilized for fine-tuning the temperature with reference to the temperature differences from the temperature sensor, so as to achieve accurate constant temperature control.

Preferably, the refrigerator of the refrigeration system is intermittently actuated and stopped as the temperature of the working fluid is required to be in high or medium temperatures, such that the smooth operation of the refrigeration system under broader temperature ranges for long periods of time is assured.

BRIEF DESCRIPTION OF THE DRAWINGS

These and other features, aspects and advantages of the present invention will become better understood with regard to the following description, appended claims and accompanying drawings that are provided only for further elaboration without limiting or restricting the present invention, where:

DETAILED DESCRIPTION OF THE PREFERRED EMBODIMENT

The following is a detailed description of the best presently known modes of carrying out the inventions. This description is not to be taken in a limiting sense, but is made merely for the purpose of illustrating the general principles of the inventions.

Figure 1:
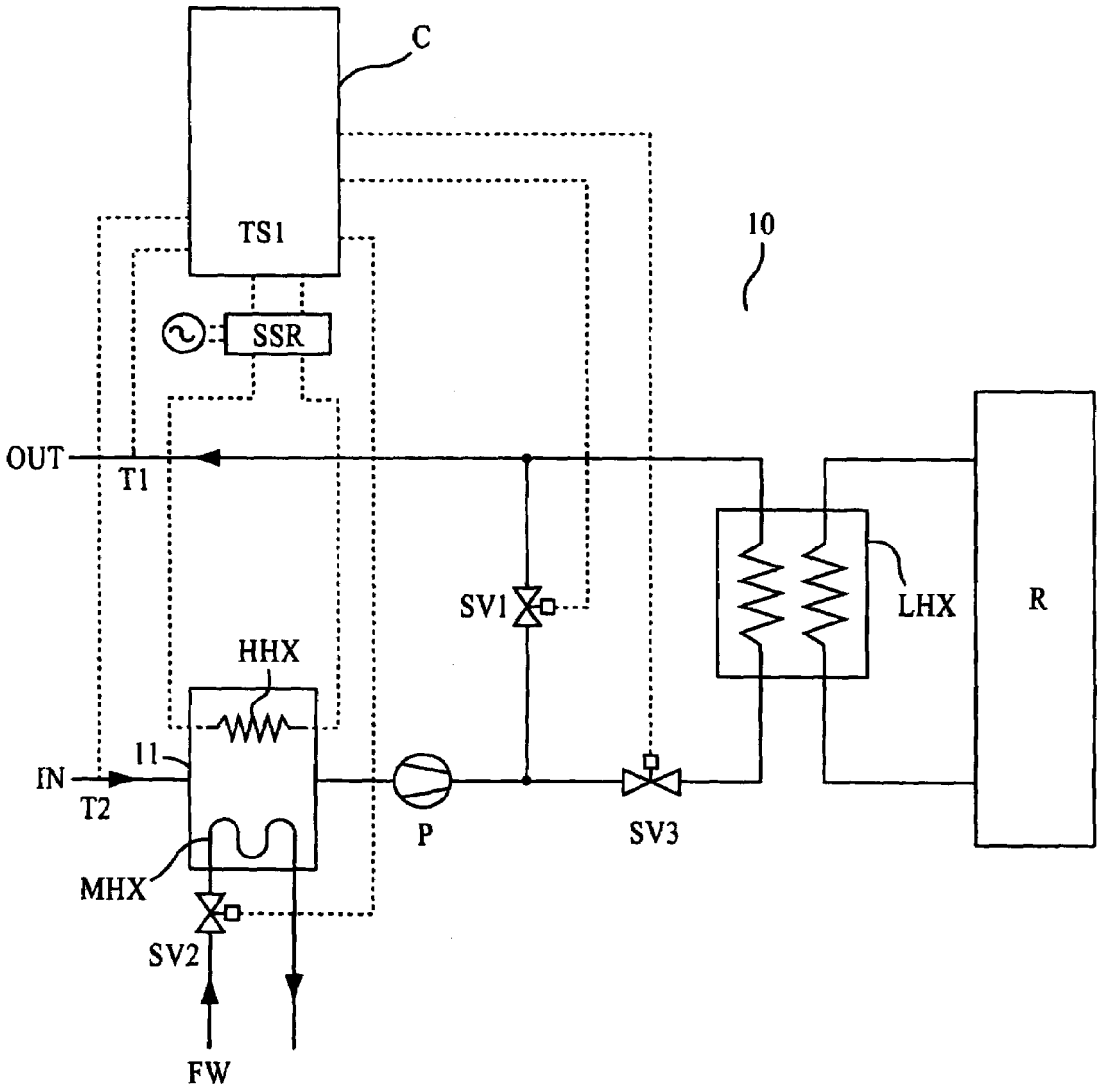
FIG. 1 shows a plot plan of the first embodiment for the method of the present invention for controlling the constant temperature refrigeration system for extensive temperature range application.

As shown in FIG. 1, the first embodiment of the constant temperature refrigeration system for extensive temperature range application 10 of the present invention comprises a refrigerator R, a low-temperature heat exchanger LHX, a medium-temperature heat exchanger MHX, a high-temperature heat exchanger HHX, a pump P, a first solenoid valve SV1, a second solenoid valve SV2, a third solenoid valve SV3, a temperature sensor TS1, a power regulator SSR and a controller C.

The medium-temperature heat exchanger MHX and the high-temperature heat exchanger HHX are both placed in a tank 11 mounted at the input end IN, and the tank 11, the pump P and the conduit of the output end OUT are connected in tandem with the first solenoid valve SV1, whereas the second solenoid valve SV2 is connected in tandem on the conduit of the medium-temperature heat exchanger MHX, and whereas the third solenoid valve SV3 is connected in tandem on the conduit of the low-temperature heat exchanger LHX while connecting in parallel with the first solenoid valve SV1. The refrigerator R is connected in tandem with the low-temperature heat exchanger LHX.

The power regulator SSR is electrically connected to the high-temperature heat exchanger HHX, an A.C. power source and the controller C respectively. The temperature sensor TS1 is mounted in the controller C, which is electrically connected to the first solenoid valve SV1, the second solenoid valve SV2 and the third solenoid valve SV3 respectively, and the temperature sensor TS1 is connected to the input end IN and the output end OUT, so as to detect the temperature T2 of the input end IN and the temperature T1 of the output end OUT. The electrical connection circuits in drawings are represented by the dotted lines therein.

The power regulator SSR is to regulate the load of the high-temperature heat exchanger HHX, and the temperature sensor TS1 is utilized for predetermining the output temperature of the working fluid. The controller is utilized for controlling the first solenoid valve, the second solenoid valve and the third solenoid valve for conveying the fluid to various heat exchangers so that the working fluid is heated or cooled.

The working fluid can be coolants, non-freezing liquids, brine or liquid mixtures, and the working fluid is introduced in the tank 11 via the input end IN and outputted driven by the pump P through the first solenoid valve SV1 via the output end OUT, and through the third solenoid valve SV3 and the low-temperature LHX via the output end OUT.

The refrigerator R provides with the cooling source below 25° C. for the low-temperature heat exchanger LHX. The facility water FW can be ice water with temperature thereof being higher than room temperature of 25° C., and such facility water FW flows through the second solenoid valve SV2 and the medium-temperature heat exchanger MHX so as to provide the medium temperature cooling source. The high-temperature heat exchanger HHX is constantly under "ON" state as the refrigeration system 10 is actuated, and the power regulator SSR is utilized for fine-tuning the temperature with reference to the temperature difference signals from the temperature sensor TS1, so as to provide with temperature compensation.

The first embodiment of the controlling method on the refrigeration system 10 is elaborated in accordance with FIG. 1 to FIG. 7 as follows.

At first, the working fluid temperature required by the refrigeration system 10 is predetermined, then the pump P is actuated for inputting the working fluid and the facility water FW into the refrigeration system 10; the predetermined temperature, the actual inputting temperature T2 of the working fluid and the actual outputting temperature T1 of the working fluid from the temperature sensor TS 1 are then read (since the predetermined temperature is set by the temperature sensor TS1, the predetermined temperature is represented by TS1) and compared, with the result of such comparison being utilized for heating or cooling the working fluid so as to cause the working fluid to reach the predetermined temperature.

Figure 7:
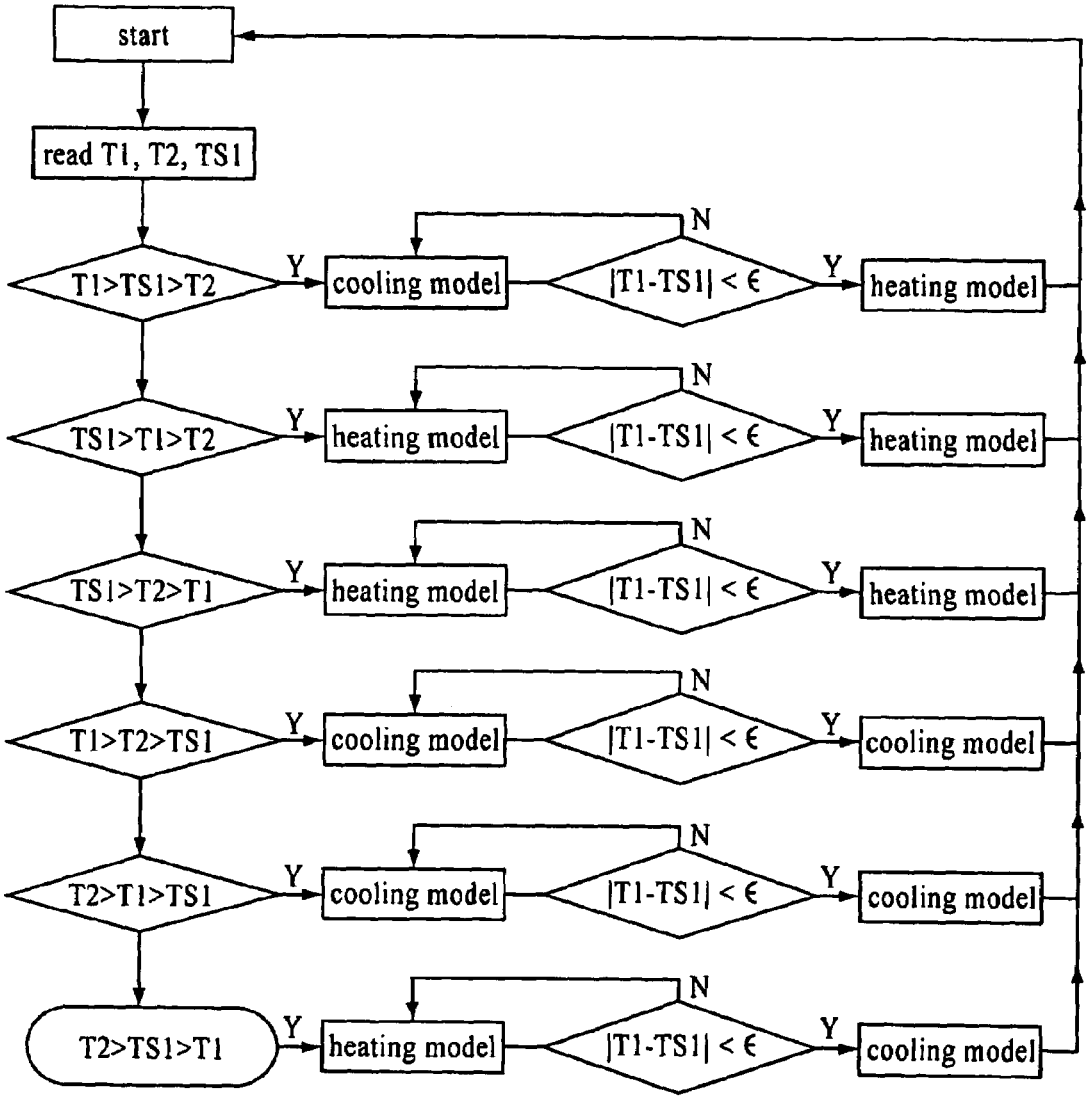
FIG. 7 shows a flow chart for the controlling method of the present invention.
Figure 8:
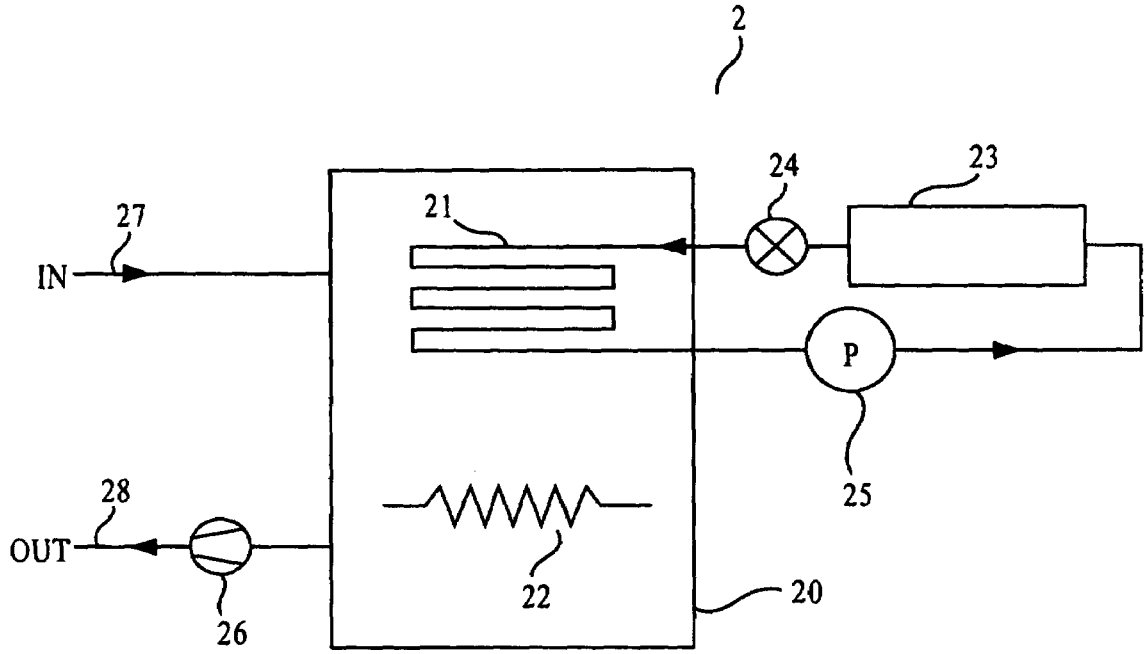
FIG. 8 Prior Art
FIG. 8 shows a plot plan of a conventional constant temperature refrigeration system.

More specifically, when comparing the predetermined temperature TS1, the actual inputting temperature T2 of the working fluid and the actual outputting temperature T1 of the working fluid, if T1 is higher than TS1, and TS1 is higher than T2, the cooling model is proceeded, at this time the difference between the outputting temperature T1 and the inputting temperature TS1 continues to be read to determine if such difference is smaller than the error value $\epsilon$ (+0.1° C. to −0.1° C.). If such difference is still larger than the error value $\epsilon$, the cooling model then proceeds continuously; if smaller, the heating model is then employed instead such that the outputting temperature T1 of the working fluid is to reach the predetermined temperature TS1 so as to maintain the temperature of the working fluid under constant temperature state within the error value, which is shown in FIG. 7. No elaboration is required for other controlling models for comparing T1, TS1 and T2.

The foregoing cooling model and the heating model are elaborated further as follows by referring to FIG. 4 and FIG. 6 in accordance with FIG. 1.

Figure 4:
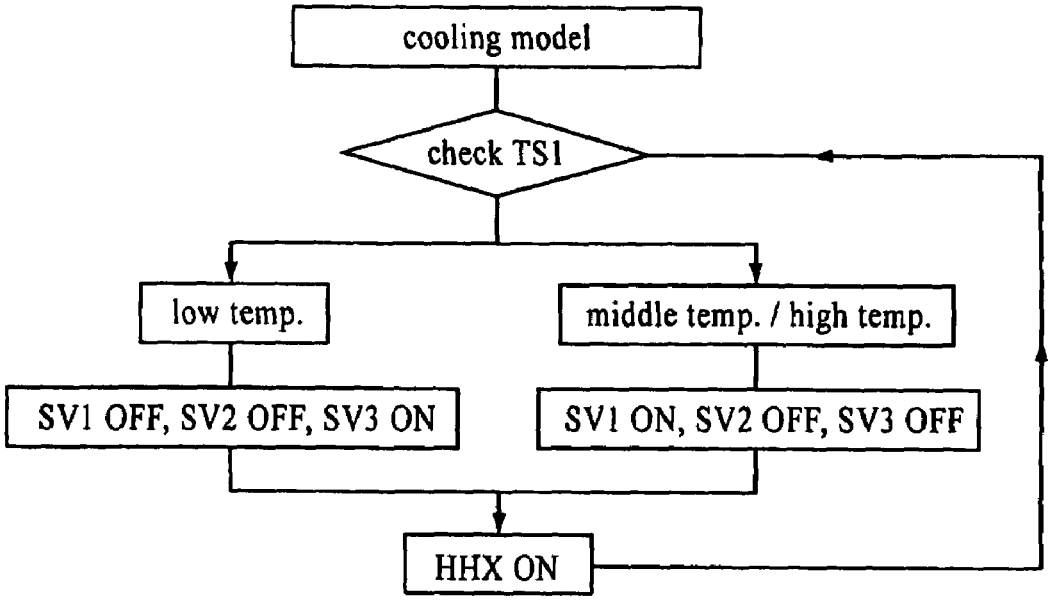
FIG. 4 shows a flow chart of the cooling model for the method of the present invention, which is applied in the first embodiment shown in FIG. 1.

As shown in FIG. 4, as the working fluid inputted is about to be cooled, the predetermined temperature TS1 is detected first, and then, as the refrigeration system 10 is for low-temperature application, the controller C is to switch the first solenoid valve SV1 as OFF, the second solenoid valve SV2 as OFF, the third solenoid valve SV3 as ON and the high-temperature heat exchanger HHX as ON, subsequently the working fluid is introduced into the tank 11 via the input end IN, then channeled by conduits to flow through the third solenoid valve SV3 and the low-temperature heat exchanger LHX, and eventually discharged through the output end OUT; as the refrigeration system 10 is for medium-temperature or high-temperature application, the controller C is to switch the first solenoid valve SV1 as ON, the second solenoid valve SV2 as OFF, the third solenoid valve SV3 as OFF and the high-temperature heat exchanger HHX as ON, subsequently the working fluid is introduced into the tank 11 via the input end IN, then channeled by conduits to flow through the first solenoid valve SV1 and eventually discharged through the output end OUT.

Figure 6:
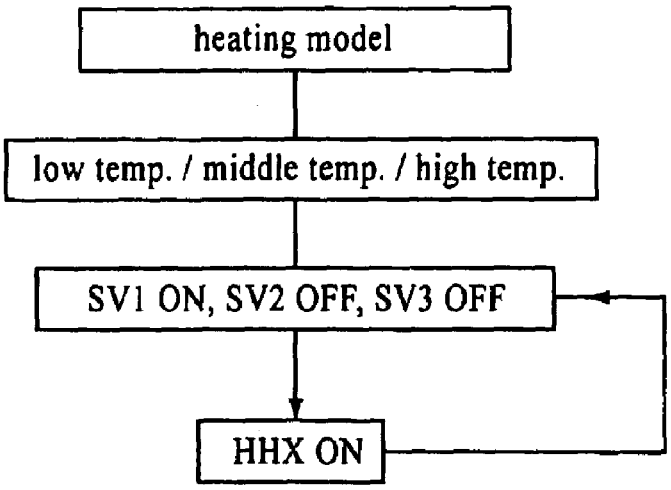
FIG. 6 shows a flow chart of a heating model for the controlling method of the present invention.

As shown in FIG. 6, as the working fluid inputted is about to be heated with the refrigeration system 10 being for low-temperature, medium-temperature or high-temperature application, the controller C is to switch the first solenoid valve SV1 as ON, the second solenoid valve SV2 as OFF, the third solenoid valve SV3 as OFF and the high-temperature heat exchanger HHX as ON, subsequently the working fluid is introduced into the tank 11 via the input end IN, then heated by the high-temperature heat exchanger HHX, and then channeled by conduits to flow through the first solenoid valve SV1 and eventually discharged through the output end OUT.

Shown in FIG. 6, the second embodiment of the constant temperature refrigeration system 10 for extensive temperature range application of the present invention comprises a refrigerator R, a low-temperature heat exchanger LHX, a medium-temperature heat exchanger MHX, a high-temperature heat exchanger LHX, a pump P, a first solenoid valve SV1, a second solenoid valve SV2 and a third solenoid valve SV3. The power regulator, the temperature sensor and the controller are all omitted in FIG. 2 for the means of electrical connections thereof are all identical to that in FIG. 1.

Figure 2:
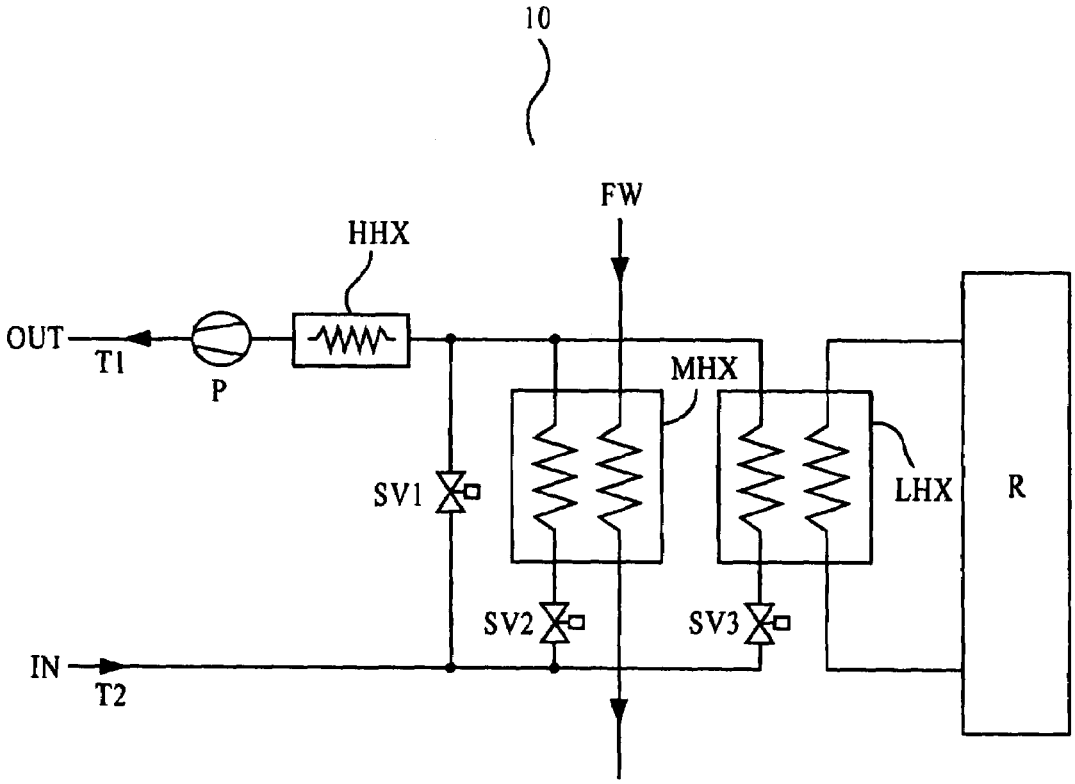
FIG. 2 shows a plot plan of the second embodiment for the method of the present invention for controlling the constant temperature refrigeration system for extensive temperature range application.

As shown in FIG. 2, the high-temperature heat exchanger HHX and the pump P are both mounted at the output end, with the conduit thereof being connected in tandem thereon with the first solenoid valve SV1, whereas the second solenoid valve SV2 is connected in tandem on the conduit of the medium-temperature heat exchanger MHX while connecting in parallel with the first solenoid valve SV1, and whereas the third solenoid valve SV3 is connected in tandem on the conduit of the low-temperature heat exchanger LHX while connecting in parallel with the first solenoid valve SV1.

The controlling method for the second embodiment of the constant temperature refrigeration system 10 for extensive temperature range application of the present invention is identical to that in FIG. 7 with the elaboration thereof being found in that of the first embodiment. However, the cooling model and the heating model of the second embodiment are elaborated further in accordance with FIG. 2, FIG. 5 and FIG. 6.

Figure 5:
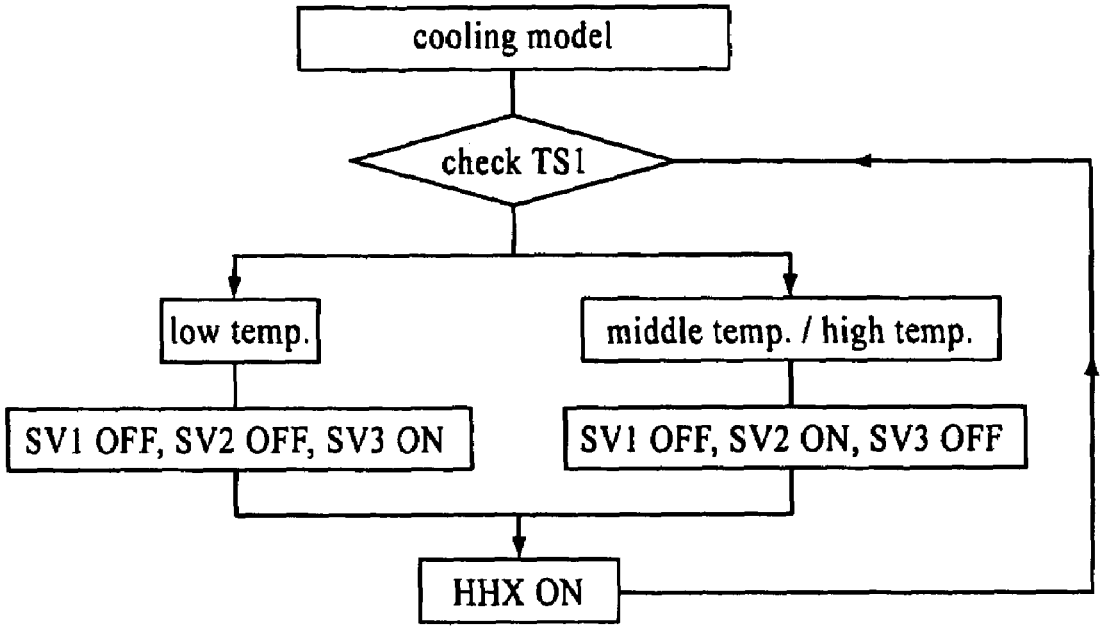
FIG. 5 shows a flow chart of another cooling model for the controlling method of the present invention, which is applied in both the second embodiment shown in FIG. 2 and the third embodiment shown in FIG. 3.

As shown in FIG. 5, as the working fluid inputted is about to be cooled, the predetermined temperature TS1 is detected first, and then, as the refrigeration system 10 is for low-temperature application, the controller C is to switch the first solenoid valve SV1 as OFF, the second solenoid valve SV2 as OFF, the third solenoid valve SV3 as ON and the high-temperature heat exchanger HHX as ON, subsequently the working fluid is introduced into the tank 11 via the input end IN, then channeled by conduits to flow through the third solenoid valve SV3, the low-temperature heat exchanger LHX and the high-temperature heat exchanger HHX, and eventually discharged through the output end OUT; as the refrigeration system 10 is for medium-temperature or high-temperature application, the controller C is to switch the first solenoid valve SV1 as OFF, the second solenoid valve SV2 as ON, the third solenoid valve SV3 as OFF and the high-temperature heat exchanger HHX as ON, subsequently the working fluid is introduced into the tank 11 via the input end IN, then channeled by conduits to flow through the second solenoid valve SV2, the medium-temperature heat exchanger MHX and the high-temperature heat exchanger HHX, and eventually discharged through the output end OUT.

As shown in FIG. 6, as the working fluid inputted is about to be heated with the refrigeration system 10 being for low-temperature, medium-temperature or high-temperature application, the controller C is to switch the first solenoid valve SV1 as ON, the second solenoid valve SV2 as OFF, the third solenoid valve SV3 as OFF and the high-temperature heat exchanger HHX as ON, subsequently the working fluid is introduced into the tank 11 via the input end IN, and then channeled by conduits to flow through the first solenoid valve SV1 and the high-temperature heat exchanger HHX, and eventually discharged through the output end OUT.

Figure 3:
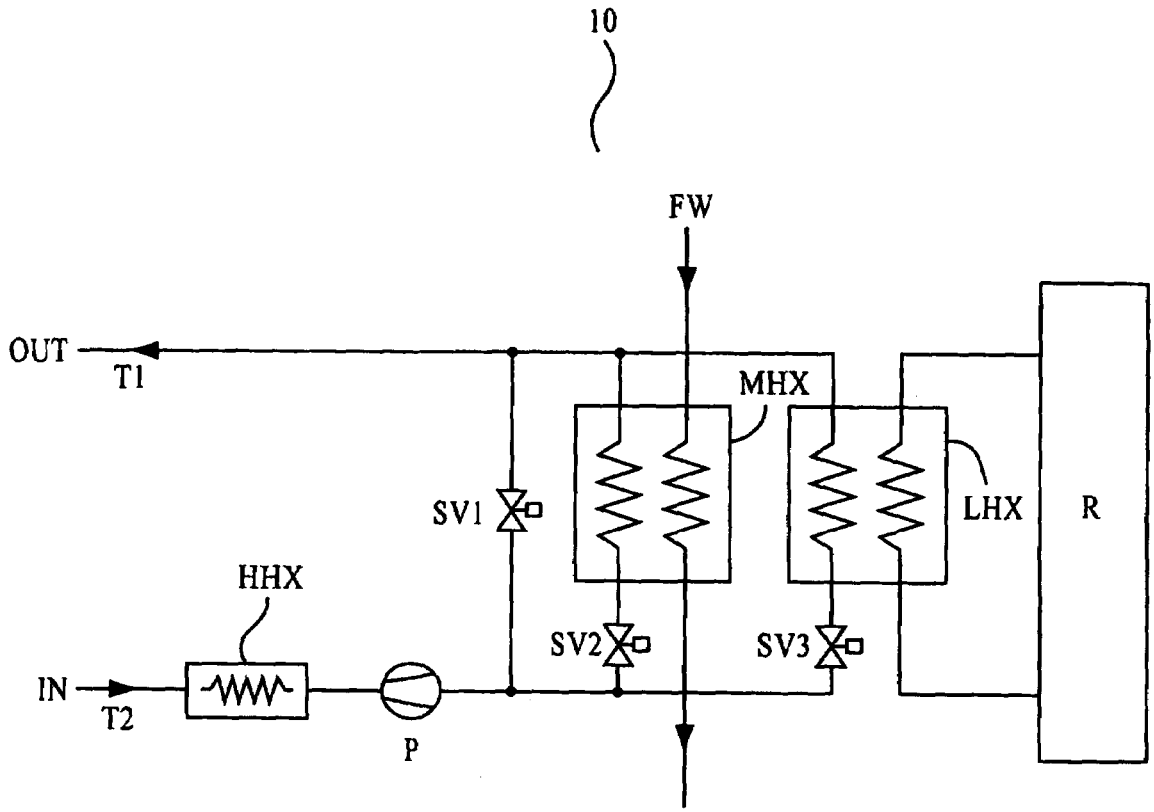
FIG. 3 shows a plot plan of the third embodiment for the method of the present invention for controlling the constant temperature refrigeration system for extensive temperature range application.

FIG. 3 shows the third embodiment of the constant temperature refrigeration system 10 for extensive temperature range application of the present invention, wherein the design is identical to that of the second embodiment except for the pump P and the high-temperature heat exchanger HHX being both mounted at the input end IN.

The controlling method for the third embodiment of the constant temperature refrigeration system 10 for extensive temperature range application of the present invention is identical to that of the first embodiment, so that it is not repeated herein. However, the cooling model and the heating model of the third embodiment are elaborated further in accordance with FIG. 3, FIG. 5 and FIG. 6.

As shown in FIG. 5, as the working fluid inputted is about to be cooled, the predetermined temperature TS1 is detected first, and then, as the refrigeration system 10 is for low-temperature application, the controller C is to switch the first solenoid valve SV1 as OFF, the second solenoid valve SV2 as OFF, the third solenoid valve SV3 as ON and the high-temperature heat exchanger HHX as ON, subsequently the working fluid is introduced into the tank 11 via the input end IN, then channeled by conduits to flow through the high-temperature heat exchanger HHX, the third solenoid valve SV3 and the low-temperature heat exchanger LHX, and eventually discharged through the output end OUT; as the refrigeration system 10 is for medium-temperature or high-temperature application, the controller C is to switch the first solenoid valve SV1 as OFF, the second solenoid valve SV2 as ON, the third solenoid valve SV3 as OFF and the high-temperature heat exchanger HHX as ON, subsequently the working fluid is introduced into the tank 11 via the input end IN, then channeled by conduits to flow through the high-temperature heat exchanger HHX, the second solenoid valve SV2 and the medium-temperature heat exchanger MHX, and eventually discharged through the output end OUT.

As shown in FIG. 6, as the working fluid inputted is about to be heated with the refrigeration system 10 being for low-temperature, medium-temperature or high-temperature application, the controller C is to switch the first solenoid valve SV1 as ON, the second solenoid valve SV2 as OFF, the third solenoid valve SV3 as OFF and the high-temperature heat exchanger HHX as ON, subsequently the working fluid is introduced into the tank 11 via the input end IN, and then channeled by conduits to flow through the high-temperature heat exchanger HHX and the first solenoid valve SV1, and eventually discharged through the output end OUT.

The high-temperature heat exchanger HHX in the foregoing embodiments is a heater that is under the "ON" state after the refrigeration system 10 is actuated, and the temperature thereof is controlled by the power regulator according to temperature variations.

The refrigerator R of the refrigeration system 10 is intermittently actuated and stopped as the temperature of the working fluid is required to be in high or medium temperatures, such that the smooth operation of the refrigeration system 10 under broader temperature ranges for long periods of time is assured.

Although the present invention has been described in considerable detail with reference to certain preferred embodiments thereof, those skilled in the art can easily understand that all kinds of alterations and changes can be made within the spirit and scope of the appended claims. Therefore, the spirit and scope of the appended claims should not be limited to the description of the preferred embodiments contained herein.

What is claimed is:

1. A constant temperature refrigeration system for extensive temperature range application comprising a refrigerator, a low temperature heat exchanger, a medium-temperature heat exchanger, a high-temperature heat exchanger, a pump, a first solenoid valve, a second solenoid valve, a third solenoid valve, a temperature sensor, a power regulator and a controller, said refrigerator, said low-temperature heat exchanger, said medium temperature heat-exchanger, said high-temperature heat exchanger, said pump, said first solenoid valve, said second solenoid valve and said third solenoid valve being connected via conduits and being mounted with an input end and an output end, a working fluid being introduced therein via said input end and driven thereout via said output end by said pump, said power regulator being utilized for regulating the load carried by said high-temperature heat exchanger, said temperature sensor being utilized for predetermining the output temperature of said working fluid, said controller being utilized for controlling said first solenoid valve, said second solenoid valve and said third solenoid valve for conveying the fluid to various said heat exchangers to heat or cool said working fluid, with the result being that the temperature of said working fluid outputted being caused to reach the predetermined temperature, thus achieving the constant temperature control, wherein said medium-temperature heat exchanger and said high-temperature heat exchanger are both placed in a tank mounted at said input end, and said tank, said pump and the conduit of said output end are connected in series with said first solenoid valve, whereas said second solenoid valve is connected in series on the conduit of said medium-temperature heat exchanger, and whereas said third solenoid valve is connected in series on the conduit of said low-temperature heat exchanger while connecting in parallel with said first solenoid valve.

2. The constant temperature refrigeration system as in claim 1, wherein said working fluid is coolant, non-freezing solution, brine or liquid mixture for manufacturing processes.

3. The constant temperature refrigeration system as in claim 1, wherein said medium-temperature heat exchanger is provided with the facility water.

4. The constant temperature refrigeration system as in claim 1, wherein said high-temperature heat exchanger is a heater.

* * * * *